US008500310B2

(12) United States Patent
Sakamoto

(10) Patent No.: US 8,500,310 B2
(45) Date of Patent: Aug. 6, 2013

(54) INDICATION PLATE

(75) Inventor: Takeshi Sakamoto, Tokyo (JP)

(73) Assignee: Sony Corporation, Tokyo (JP)

( * ) Notice: Subject to any disclaimer, the term of this patent is extended or adjusted under 35 U.S.C. 154(b) by 475 days.

(21) Appl. No.: 12/405,286

(22) Filed: Mar. 17, 2009

(65) Prior Publication Data

US 2009/0237939 A1 Sep. 24, 2009

(30) Foreign Application Priority Data

Mar. 18, 2008 (JP) ..... 2008-068923

(51) Int. Cl.
*F21V 17/02* (2006.01)

(52) U.S. Cl.
USPC ..... 362/330; 362/336; 362/338; 362/334; 362/335

(58) Field of Classification Search
USPC ..... 362/317, 326–340, 351–361, 606, 362/607, 617–19
See application file for complete search history.

(56) References Cited

U.S. PATENT DOCUMENTS

| | | | | |
|---|---|---|---|---|
| 2,228,691 | A * | 1/1941 | Crosser | 362/255 |
| 2,648,925 | A * | 8/1953 | Owen et al. | 40/549 |
| 4,891,896 | A * | 1/1990 | Boren | 40/541 |
| 4,976,057 | A * | 12/1990 | Bianchi | 40/579 |
| 6,729,055 | B2 * | 5/2004 | Chou | 40/546 |
| 7,217,024 | B2 * | 5/2007 | Good et al. | 362/604 |
| 7,303,312 | B2 * | 12/2007 | Wang | 362/249.16 |
| 7,387,397 | B2 * | 6/2008 | Konet et al. | 362/84 |
| 7,824,078 | B2 * | 11/2010 | Peng et al. | 362/351 |
| 2002/0181234 | A1 * | 12/2002 | Kawahara | 362/257 |
| 2005/0128757 | A1 * | 6/2005 | Schneider | 362/398 |
| 2006/0061994 | A1 * | 3/2006 | Liao | 362/257 |
| 2006/0126352 | A1 * | 6/2006 | Kwon | 362/540 |

FOREIGN PATENT DOCUMENTS

| | | |
|---|---|---|
| JP | 59 150653 | 10/1984 |
| JP | 61 19279 | 2/1986 |
| JP | 2 59320 | 2/1990 |
| JP | 5 66680 | 9/1993 |
| JP | 7 23371 | 4/1995 |
| JP | 2003 160012 | 6/2003 |
| JP | 2005 134789 | 5/2005 |

* cited by examiner

*Primary Examiner* — Jong-Suk (James) Lee
*Assistant Examiner* — Bryon T Gyllstrom
(74) *Attorney, Agent, or Firm* — Frommer Lawrence & Haug LLP; William S. Frommer

(57) ABSTRACT

Disclosed herein is an indication plate including: a plate member including a light-transmitting material; and an indication part provided at a surface on one side with respect to the thickness direction of the plate member, wherein the indication part includes a light-shielding part including a light-shielding material and covering the surface on one side, and a convex portion including the light-transmitting material, the convex portion projecting from the surface on one side and being exposed from the light-shielding part; the convex portion has a circumferential surface projecting from the light-shielding part, and an end face connecting tip portions of the circumferential surface to each other, and a metallic foil having a light-transmitting property is attached to the end face.

8 Claims, 6 Drawing Sheets

Related Art

INDICATION PLATE

CROSS REFERENCES TO RELATED APPLICATIONS

The present invention contains subject matter related to Japanese Patent Application JP 2008-068923 filed in the Japan Patent Office on Mar. 18, 2008, the entire contents of which being incorporated herein by reference.

BACKGROUND OF THE INVENTION

1. Field of the Invention

The present invention relates to an indication plate.

2. Description of the Related Art

A casing constituting an external body of an electronic apparatus such as a television set, in many cases, has attached thereto an indication plate for indicating (displaying) a logo mark or the like.

As such an indication plate, there has been provided one that is manufactured by the steps shown in FIGS. 7A to 7D.

First, as shown in FIG. 7A, a cavity of a mold is charged with a molten synthetic resin used as a light-transmitting material, whereby a convex portion or portions 54 having a shape to represent a logo mark or the like is formed at a surface on one side of a plate member 52.

Next, as shown in FIG. 7B, a light-shielding coating material 56 is applied to the whole area of the one-side surface inclusive of the convex portion(s) 54.

Then, as shown in FIG. 7C, the light-shielding coating material 56 on the tips of the convex portions 54 is shaved or scraped off, to expose the tip end faces 54A of the convex portions 54.

An indication plate 50 formed in this manner is used as follows.

A light source 2 is disposed on the back side of the indication plate 50.

When the light source 2 is turned ON, light is transmitted through the plate member 52 including the light-transmitting material, to be radiated through the tip end faces 54A to the exterior, so that the shape representing the logo mark or the like is visually recognized as if it were emitting light.

In the case of such an indication plate, however, the indication (display) of the logo mark or the like disappears when the light source 2 is turned OFF.

In view of this, a measure may be contemplated in which as shown in FIG. 7D, a metallic foil 58 having a light-transmitting property is attached to the tip end faces 54A. In this case, even in the condition after the light source 2 is turned OFF, external light is reflected by the metallic foil 58, so that the indication (display) of the logo mark can be retained.

The attachment of the metallic foil 58 to the tip end faces 54A is preferably carried out by a method in which a metallic foil 58 is attached to the tip end faces 54A by hot stamping (refer to Japanese Patent Laid-open No. Hei 6-183125, Japanese Patent Laid-open No. Hei 9-50239 and Japanese Patent Laid-open No. 2003-248446).

SUMMARY OF THE INVENTION

On the other hand, in the above-mentioned configuration, the shaving of the tip ends of the convex portions 54 to thereby expose the tip end faces 54A, as shown in FIG. 7C, results in that an annular surface or surfaces 56A of the light-shielding coating material 56 are formed so as to surround the periphery of the tip end faces 54A, and the tip end face(s) 54A and the annular surface(s) 56A are flush with each other.

In the case of attaching the metallic foil 58 to the tip end faces 54A by hot stamping in the condition where the tip end faces 54A and the annular surfaces 56A are flush with each other, it is difficult to match the edges of the metallic foil 58 to the boundary lines between the tip end faces 54A and the annular surfaces 56A, which is disadvantageous from the viewpoint of securing appearance quality.

Besides, in the above-mentioned indication plate 50, the step of applying the light-shielding coating material 56 to the whole area of the surface on one side of the plate member 52 and the step of shaving or scraping off the light-shielding coating material 56 applied to the tip ends of the convex portions 54 are desired. Therefore, the manufacturing process is complicated, which is disadvantageous from the viewpoint of achieving a reduced manufacturing cost.

Thus, there is a need for an indication plate which is advantageous from the viewpoint of achieving a reduced manufacturing cost while enhancing appearance quality.

In accordance with an embodiment of the present invention, there is provided an indication plate including a plate member including a light-transmitting material; and an indication part provided at a surface on one side with respect to the thickness direction of the plate member, wherein the indication part includes a light-shielding part including a light-shielding material and covering the surface on one side, and a convex portion including the light-transmitting material, the convex portion projecting from the surface on one side and being exposed from the light-shielding part; the convex portion has a circumferential surface projecting from the light-shielding part, and an end face connecting tip portions of the circumferential surface to each other; and a metallic foil having a light-transmitting property is attached to the end face.

According to the embodiment of the present invention, it is possible to obtain advantages from the viewpoints of enhancing appearance quality of an indication plate and achieving a reduced manufacturing cost of the indication plate.

DETAILED DESCRIPTION OF THE PREFERRED EMBODIMENTS

Figure 1:
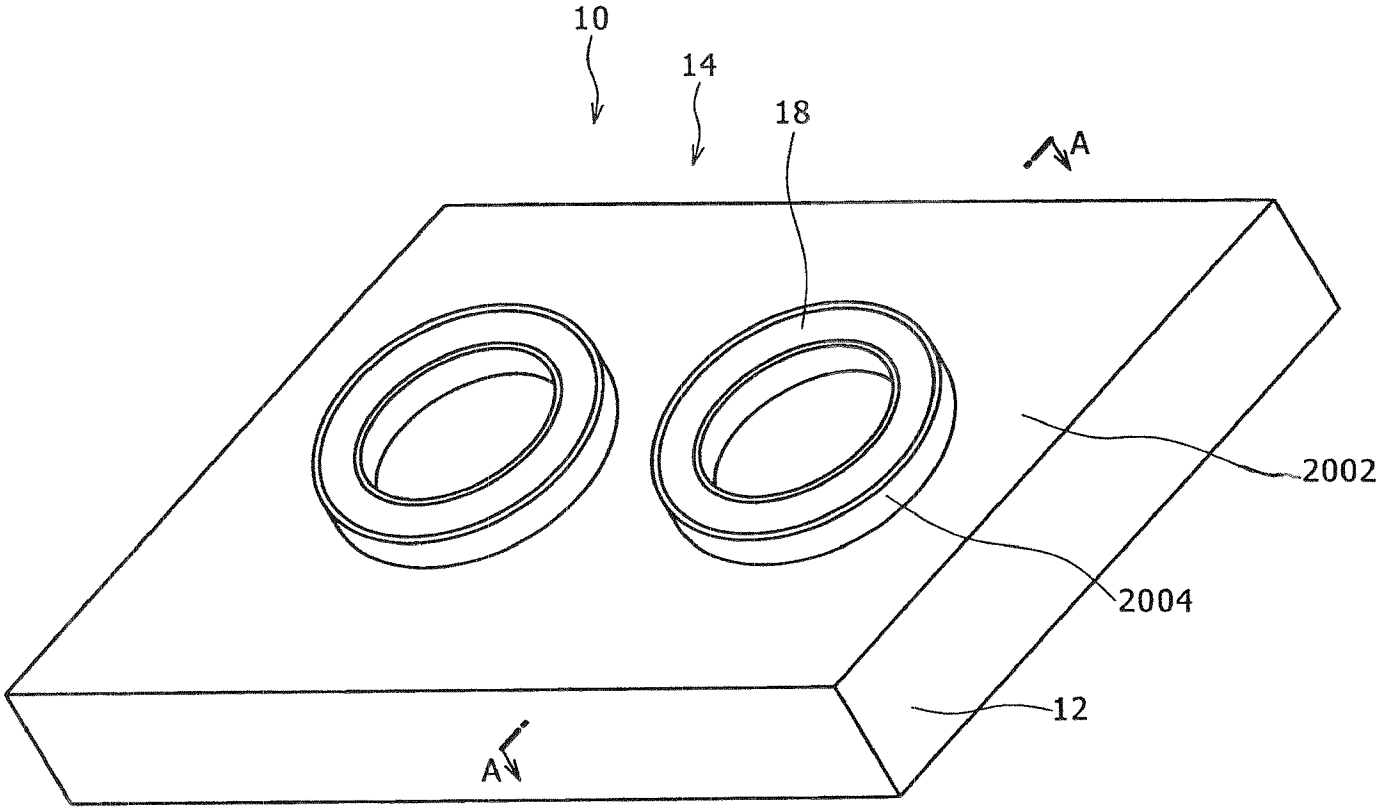
FIG. 1 is a perspective view of an indication plate according to one embodiment of the present invention.

Now, an embodiment of the present invention will be described below referring to the drawings.

Figure 2:
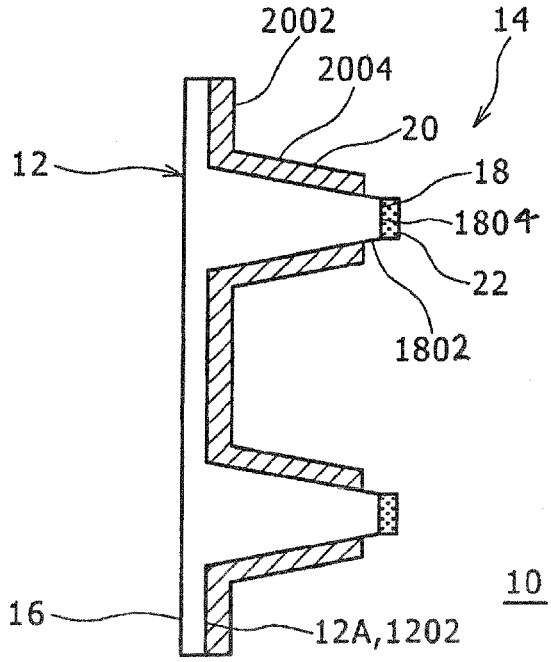
FIG. 2 is a sectional view taken along line A-A of FIG. 1.

FIG. 1 is a perspective view of an indication plate 10 according to one embodiment of the present invention, and FIG. 2 is a sectional view taken along line A-A of FIG. 1.

First, the configuration of the indication plate 10 will be described referring to FIGS. 1 and 2.

The indication plate 10 has a plate member 12 and an indication part 14.

The plate member 12 includes a light-transmitting material permitting light to be transmitted therethrough.

In the present embodiment, a translucent white synthetic resin is adopted as the light-transmitting material. As the light-transmitting material, however, a variety of well-known synthetic materials permitting light to be transmitted therethrough can be adopted.

The indication part 14 is provided at a surface 12A on one side with respect to the thickness direction of the plate member 12.

The display part 14 includes convex portions 18, and a light-shielding part 20.

The convex portions 18 each have a circumferential surface 1802 and an end face 1804.

A metallic foil 22 is attached to the end faces 1804.

In the present embodiment, the end faces 1804 and the metallic foil 22 form two English letters "O."

More specifically, the surface 12A on one side is covered with a light-shielding part 20 including a light-shielding material. The convex portions 18 includes the light-shielding material, project from the surface 12A on one side, and are exposed from the light-shielding part 20.

Thus, the surface 12A on one side of the plate member 12 includes a flat surface 1202, and the convex portions 18 projecting from the flat surface 1202.

In the present embodiment, the convex portions 18 are provided in plurality.

Besides, the surface on the other side with respect to the thickness direction of the plate member 12 is a back surface 16 including a flat surface.

Figure 3:
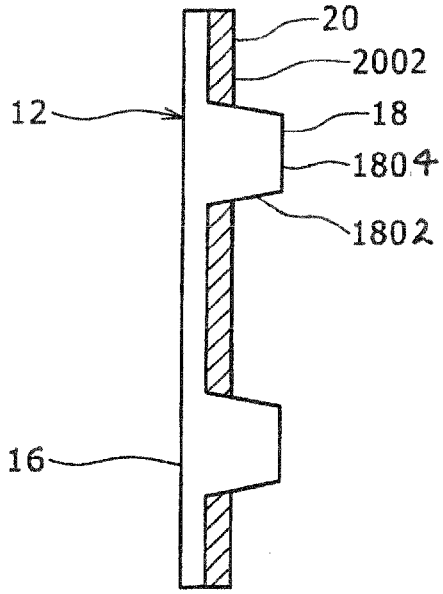
FIG. 3 illustrates a modification of a light-shielding part.
Figure 4:
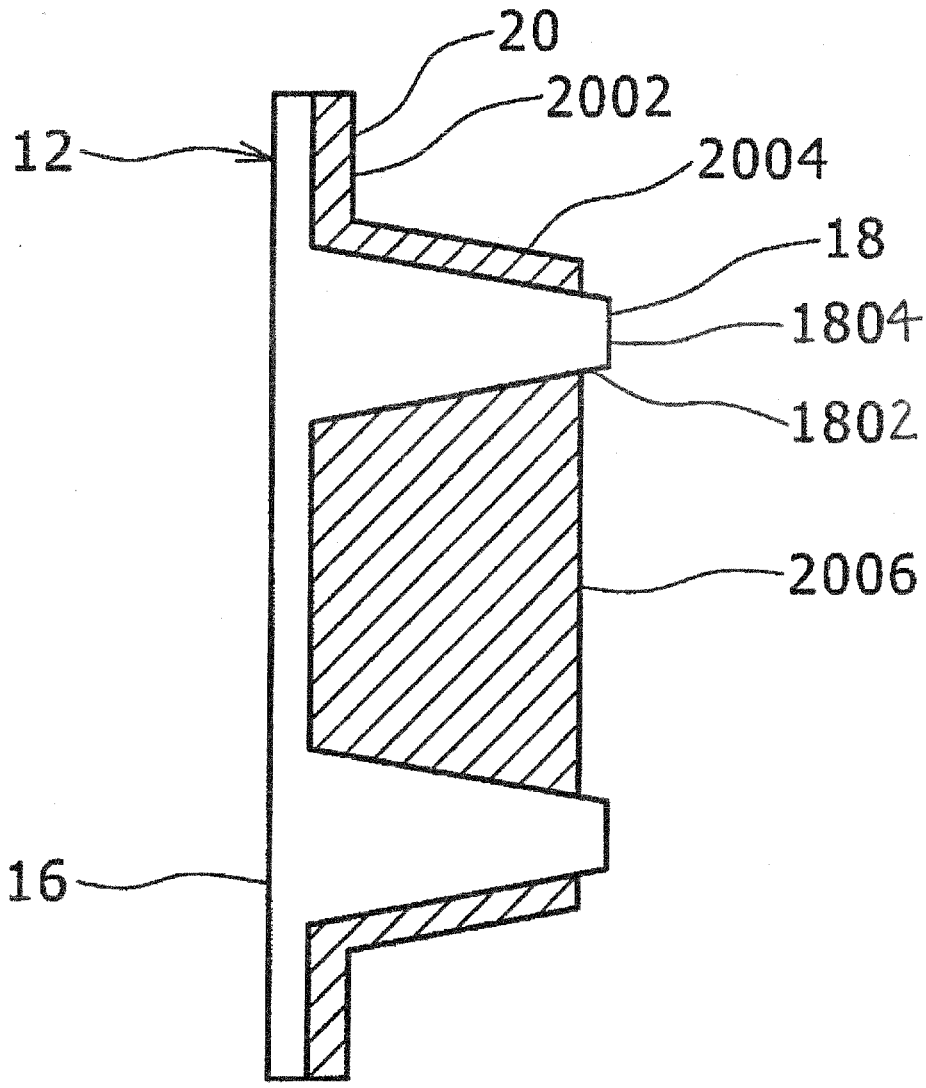
FIG. 4 illustrates another modification of the light-shielding part.

The light-shielding part 12 has a flat portion 2002 covering the flat surface 1202, and rising portions 2004 rising along the circumferential surfaces 1802 of the convex portions 18. Incidentally, the rising portions 2004 may be omitted, as shown in FIG. 3, and the light-shielding part 20 may have the flat portion 2002 only. Or, as shown in FIG. 4, the light-shielding part 20 may have a flat portion 2002 covering the flat surface 1202, rising portions 2004 rising along the circumferential surfaces 1802 of the convex portions 18, and a filled portion 2006 wherein a recessed part surrounded by the convex portions 18 is filled with the light-shielding material. In short, the shape of the light-shielding part 20 is appropriately determined according to such factors as the shape and height of the convex portions 18.

In the present embodiment, a black ABS resin is adopted as the light-shielding material. As the light-shielding material, however, a variety of well-known synthetic materials capable of shielding light can be adopted.

The convex portions 18 as well as the end faces 1804 and the metallic foil 22 to be described later are determined according to the subject matter to be indicated (displayed) on the indication plate 10. Specifically, where the indication plate 10 is a nameplate, the convex portions 18 and the end faces 1804 and the metallic foil 22 form characters representing a company name and/or a trade name. Where the indication plate 10 is a trademark, the convex portions 18 and the end faces 1804 and the metallic foil 22 form characters, a figure or the like. Further, where the indication plate 10 is a mark or a sign affixed to a control panel, the convex portions 18 and the end faces 1804 and the metallic foil 22 form character(s), symbol(s), a figure or the like.

The circumferential surfaces 1802 of the convex portions 18 are projecting from the light-shielding part 20.

The end faces 1804 of the convex portions 18 are surfaces connecting tip portions of the circumferential surfaces 1802 to each other. In the present embodiment, the end faces 1804 are composed of flat surfaces parallel to the back surface 16.

The circumferential surfaces 1802 and the end faces 1804, in the present embodiment, intersect each other through corner portions.

The metallic foil 22 is attached to the end faces 1804 by hot stamping. The metallic foil 22 has a light-transmitting property.

In the present embodiment, for example, an aluminum foil having a thickness of 1 to 10 μm is adopted as the metallic foil 22. As the metallic foil 22, however, a variety of metallic foils having a light-transmitting property can be adopted.

Now, the case where the indication plate 10 is used in the state of being attached to a casing of an electronic apparatus will be described below.

Figure 5:
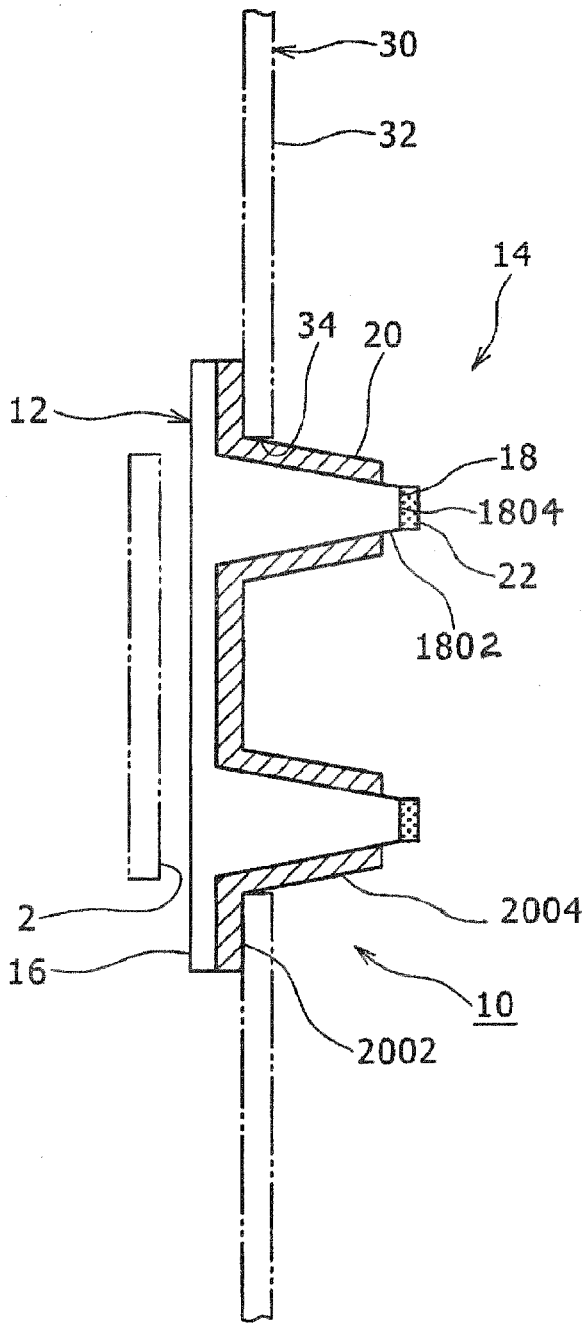
FIG. 5 illustrates the condition in use of the indication plate.

As shown in FIG. 5, a wall part 32 of the casing 30 is provided with an opening 34 through which the convex portions 18 and the rising portions 2004 of the indication plate 10 can be passed.

The convex portions 18 of the indication plate 10 are passed through the opening 34 from the inner side of the wall part 32, and, in the condition where the flat portion 2002 in the periphery of the convex portions 18 are in contact with the inside surface of the wall part 32, the indication plate 10 is attached to the wall part 32 by use of an adhesive, for example.

A light source 2 is mounted in a location fronting on the back surface 16 of the indication plate 10.

When the light source 2 is turned ON, the light emitted from the light source 2 enters into the inside of the plate member 12 through the back surface 16, is transmitted through the inside of the plate member 12 to reach the end faces 1804 and hence the metallic foil 22, and is transmitted through the metallic foil 22, to be emitted to the front side.

When the indication plate 10 is viewed, therefore, the condition where the end faces 1804 (the metallic foil 22) and the circumferential surfaces 1802 are emitting light is visually recognized, so that character(s), symbol(s), a figure or the like is visually recognized in a light-emitting state.

In addition, with the light source 2 turned OFF, external light is reflected by the metallic foil 22, so that the character(s), symbol(s), figure or the like is visually recognized as lustrous surface.

Therefore, with the light source 2 turned ON or OFF, it can be ensured that the character(s), symbol(s), figure or the like is displayed as emitting light or that the character(s), symbol(s), figure or the like is displayed as lustrous surface. This is advantageous from the viewpoint of enhancing visibility and decorativeness.

The number of the light source(s) 2 laid out and the luminescent color of the light source 2 can naturally be selected arbitrarily.

Now, a manufacturing process for the indication plate 10 will be described.

Figure 6:
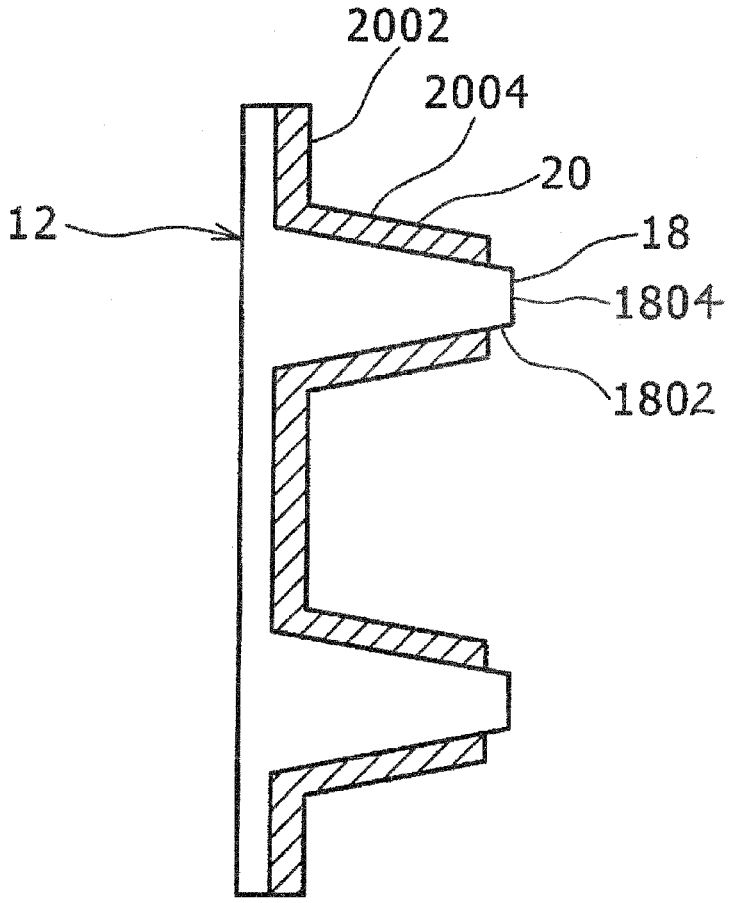
FIG. 6 illustrates two-color molding.
Figure 7A:
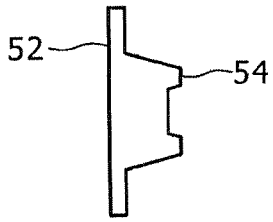
FIGS. 7A to 7D illustrate manufacturing steps of an indication plate according to the related art.
Figure 7B:
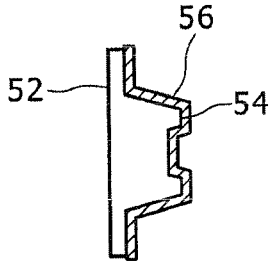
Figure 7C:
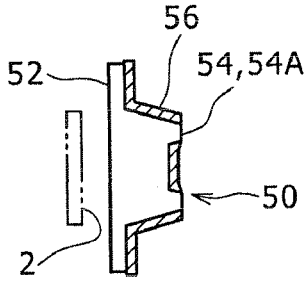
Figure 7D:
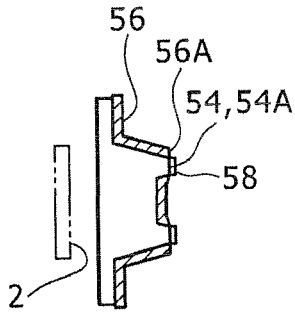

As shown in FIG. 6, the plate member 12 and the light-shielding part 20 are formed by two-color molding.

Specifically, a cavity of a mold is charged with a molten synthetic resin which is a light-transmitting material, whereby the plate member 12 inclusive of the convex portions 18 is molded.

Further, the plate member 12 is placed in another mold, and, while utilizing the plate member 12 as part of the mold, the mold is charged with a light-transmitting material, to mold the light-shielding part 20.

Subsequently, as shown in FIG. 2, the metallic foil 22 is attached to the end faces 1804 by hot stamping.

By these steps, the indication plate 10 is completed.

As has been described above, according to the present embodiment, the circumferential surfaces 1802 and the end faces 1804 of the convex portions 18 are exposed from the light-shielding part 20, and the metallic foil 22 having a light-transmitting property is attached to the end faces 1804. This is advantageous for accurately matching the edges of the metallic foil 22 to the edges of the end faces 1804.

In other words, this is advantageous for obtaining good parting of the metallic foil 22, for enhancing the appearance quality of the indication plate 10, and for enhancing the commercial value of the indication plate 10 and, hence, of the product to which the indication plate 10 is attached.

In addition, in the present embodiment, the convex portions 18 and the light-shielding part 20 can be formed by two-color molding. Therefore, the step of shaving or scraping off the light-shielding coating material 56 applied to the tip ends of the convex portions 54, as is desired in the case of the indication plate 50 according to the related art shown in FIGS. 7A to 7D, can be eliminated, which is advantageous in achieving a lower manufacturing cost.

It should be understood by those skilled in the art that various modifications, combinations, sub-combinations and alterations may occur depending on design requirements and other factor in so far as they are within the scope of the appended claims or the equivalents thereof.

What is claimed is:

1. An indication plate comprising: a plate member including a light-transmitting material; and an indication part provided at a surface on one side with respect to the thickness direction of said plate member, wherein said indication part includes a light-shielding part including a light-shielding material and covering said surface on one side, and a convex portion including said light-transmitting material, said convex portion projecting from said surface on one side and being exposed from said light-shielding part, said convex portion comprising: at least one circumferential surface projecting from said light-shielding part, and an end face connecting portions of said circumferential surface to each other, and a metallic toil having a light-transmitting property is attached to said end face, wherein the convex portion and the light-shielding part are formed without shaving or scraping off the light-shielding material applied to the end face, and wherein shapes of the end face and the metallic foil are determined based on subject matter to be indicated on the indication plate, and edges of the metallic foil match edges of the end face: wherein said surface on one side includes a flat surface, and wherein said light-shielding part has a flat surface portion covering said flat surface, and a rising portion rising along the circumferential surface of said convex portion, said rising portion of said light-shielding part projecting from said flat surface portion of said light shielding part.

2. The indication plate as set forth in claim 1,
wherein said end face includes a flat surface.

3. The indication plate as set forth in claim 1,
wherein a back surface constituting a surface on the other side with respect to the thickness direction of said plate member includes a flat surface, and
said end face includes a flat surface parallel to said back surface.

4. The indication plate as set forth in claim 1, wherein
said surface on one side includes
said convex portion projecting from this flat surface.

5. The indication plate as set forth in claim 1,
wherein said circumferential surface and said end face intersect each other through a corner portion.

6. The indication plate as set forth in claim 1,
wherein said light-shielding material is a black synthetic resin,
said light-transmitting material is a translucent white synthetic resin, and said metallic foil is an aluminum foil.

7. The indication plate as set forth in claim 1,
wherein a plurality of said indication parts are provided.

8. The indication plate as set forth in claim 1,
wherein said convex portion and said light-shielding part are formed by two-color molding.

* * * * *